US007950658B2

(12) United States Patent
Kotaka

(10) Patent No.: US 7,950,658 B2
(45) Date of Patent: May 31, 2011

(54) RECORDING MEDIUM TRANSPORTING DEVICE AND RECORDING APPARATUS

(75) Inventor: Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 227 days.

(21) Appl. No.: 12/274,013

(22) Filed: Nov. 19, 2008

(65) Prior Publication Data

US 2009/0134571 A1 May 28, 2009

(30) Foreign Application Priority Data

Nov. 26, 2007 (JP) ..... 2007-304449

(51) Int. Cl.
*B65H 5/00* (2006.01)

(52) U.S. Cl. ..... 271/264; 271/10.09; 271/272

(58) Field of Classification Search ..... 271/271–274, 271/314, 264, 10.09, 10.11; 347/101, 104, 347/105

See application file for complete search history.

(56) References Cited

U.S. PATENT DOCUMENTS

| | | | | |
|---|---|---|---|---|
| 6,816,229 | B2 * | 11/2004 | Oono | 355/18 |
| 6,854,843 | B2 * | 2/2005 | Anami et al. | 347/104 |
| 7,018,034 | B2 * | 3/2006 | Rasmussen et al. | 347/104 |
| 2005/0225622 | A1 * | 10/2005 | Anami et al. | 347/104 |

FOREIGN PATENT DOCUMENTS

| | | |
|---|---|---|
| JP | 05-085001 | 4/1993 |
| JP | 10-272767 | 10/1998 |
| JP | 2003-320662 | 11/2003 |
| JP | 2004-122609 | 4/2004 |
| JP | 2004-322632 | 11/2004 |
| JP | 2005-153147 | 6/2005 |

* cited by examiner

*Primary Examiner* — Stefanos Karmis
*Assistant Examiner* — Thomas A Morrison
(74) *Attorney, Agent, or Firm* — Workman Nydegger

(57) ABSTRACT

A recording medium transporting device includes a transporting unit that transports a recording medium; a guide member that supports and guides the recording medium in a downstream direction, the guide member being disposed downstream of the transporting unit; and a restraining unit that includes a restraining member having a restraining section, the restraining section being movable relative to the guide member. The restraining section imposes a restraint on the recording medium to prevent the recording medium from rising above the guide member at a position downstream of the transporting unit. A restriction state of the restraining member is switchable between at least two states, and the restriction state is switched so that a degree of the restraint is reduced or the restraint is removed before a trailing edge of the recording medium passes the restraining section.

6 Claims, 6 Drawing Sheets

RECORDING MEDIUM TRANSPORTING DEVICE AND RECORDING APPARATUS

BACKGROUND

1. Technical Field

The present invention relates to a transporting device that transports a recording medium in a recording apparatus such as a facsimile machine or a printer, and a recording apparatus including the transporting device.

2. Related Art

An ink jet printer is an example of a recording apparatus. The ink jet printer has a transporting unit that transports a recording sheet as an example of the recording medium. The transporting unit is disposed upstream of a recording head that ejects ink. The transporting unit has a pair of rollers including a drive roller that is rotated and a driven roller that is rotated by contacting the drive roller.

A guide member (platen) is disposed downstream of the transporting unit at a position facing the recording head. The guide member supports and guides the recording sheet in the downstream direction. If the recording sheet rises above the guide member, the distance between the recording head and the recording sheet becomes inappropriate and the recording quality is impaired. To prevent the recording sheet from rising above the guide member, the position of the nip point between the drive roller and the driven roller of the transporting unit may be adjusted such that the transporting unit feeds the recording sheet toward the surface of the guide member, that is, such that the recording sheet is pressed against the guide member.

However, the effect of pressing the sheet against the guide member by the transporting unit may be insufficient. Therefore, a restraining device that restrains the recording sheet from rising as described in Japanese Patent No. 3894311, or a pressing section that presses the recording sheet against the guide member as described in Japanese Unexamined Patent Application Publication No. 2004-322632 may be provided immediately downstream of the transporting unit.

However, in the recording apparatus described in Japanese Unexamined Patent Application Publication No. 2004-322632, the pressing section applies a transport load to the recording sheet before the trailing edge of the recording sheet passes the pressing section. Furthermore, when the trailing edge of the recording sheet passes the pressing section, the transport load is suddenly released. At this time, the trailing edge of the recording sheet, having passed the transporting unit, is free from the restraint applied by the transporting unit. Since the transport load applied by the pressing section is suddenly released in such a situation, the accuracy with which the recording sheet is fed fluctuates and impairs the recording quality. A similar technical problem may occur in the recording apparatus described in Japanese Patent No. 3894311.

SUMMARY

An advantage of some aspects of the invention is that a fluctuation in transport load when the trailing edge of a recording sheet passes a restraining section is eliminated, thereby preventing a reduction in recording quality due to the fluctuation in transport load, while allowing the restraining section to restrain the recording sheet from rising above the guide member.

According to a first aspect of the invention, a recording medium transporting device includes a transporting unit that transports a recording medium; a guide member that supports and guides the recording medium in a downstream direction, the guide member being disposed downstream of the transporting unit; and a restraining unit that includes a restraining member having a restraining section, the restraining section being movable relative to the guide member. The restraining section imposes a restraint on the recording medium to prevent the recording medium from rising above the guide member at a position downstream of the transporting unit. A restriction state of the restraining member is switchable between at least two states, and the restriction state is switched so that a degree of the restraint is reduced or the restraint is removed before a trailing edge of the recording medium passes the restraining section.

In this aspect, the restraining unit, including the restraining member having the restraining section that imposes the restraint on the recording medium to prevent the recording medium from rising above the guide member, can reduce the degree of the restraint or remove the restraint by the restraining section before the trailing edge of the recording medium passes the restraining section by switching the restriction state of the restraining member. Therefore, a significant fluctuation of transport load that occurs when the trailing edge of the recording medium passes the restraining section can be eliminated. Thus, reduction in recording quality due to the fluctuation in transport load when the trailing edge of the recording medium passes the restraining section is prevented.

In the recording medium transporting device according to the first aspect of the invention, it is preferable that the restraining unit reduce the degree of the restraint or remove the restraint imposed by the restraining section before the trailing edge of the recording medium passes the transporting unit.

When the trailing edge of the recording medium passes the transporting unit, the trailing edge of the recording medium becomes free from the restraint by the transporting unit. Therefore, when the degree of the restraint by the restraining section for preventing a sheet from rising is reduced or the restraint is removed in this state, the trailing edge is susceptible to fluctuation in transport load. That is, feeding accuracy tends to be reduced when the degree of the restraint is reduced or the restraint is removed.

In the preferred case, however, since the restraining unit reduces the degree of the restraint or removes the restraint by the restraining section before the trailing edge of the recording medium passes the transporting unit, the reduction in the feeding accuracy caused by reducing the degree of the restraint or removing the restraint can be prevented.

In the recording medium transporting device according to the first aspect of the invention, it is preferable that the transporting unit include a drive roller that is rotated and a driven roller that is rotated by contacting the drive roller. It is preferable that the restraining unit include a first movable member serving as the restraining member, the first movable member being pivotably disposed on a holder member that supports the driven roller and having the restraining section at a position distant from a pivot axis of the first movable member. It is preferable that the restraining unit include a second movable member disposed on the holder member, the second movable member being engageable with the first movable member and capable of taking a restrictive position at which the second movable member restricts the first movable member to a state in which the first movable member is pivoted in a direction such that the restricting section approaches the guide member and an unrestrictive position at which the second movable member does not restrict the first movable member. It is preferable that the second movable member include a contact section that is capable of being in contact with the recording medium at a position upstream of the transporting unit. It is preferable that the second movable member move from the unrestrictive position to the restrictive position as the recording medium applies a pressure to the contact section when the trailing edge of the recording medium is upstream of the contact section; and the second movable member take the unrestrictive position as the pressure on the contact section applied by the recording medium is released after the trailing edge of the recording medium passes the contact section.

In this case, the restraining unit includes the first movable member serving as the restraining member and the second movable member. Since the restriction state of the first movable member (restraining member) is configured to be switched by the pressure of the recording medium on the second movable member, the restriction state of the first movable member (restraining member) can be changed without using a dedicated driving source. Therefore, the restraining unit can be provided at low cost.

In the recording medium transporting device according to the first aspect of the invention in the case described just above, it is preferable that the contact section include a roller that is rotatable in contact with the recording medium. In this case, since the contact section includes the roller that is capable of rotating in contact with the recording medium, occurrence of transport load can be prevented when the contact section comes into contact with the recording medium.

In the recording medium transporting device according to the first aspect of the invention, it is preferable that the transporting unit include a drive roller that is rotated and a driven roller that is rotated by contacting the drive roller; the restraining unit include a pivot member serving as the restraining member, the pivot member being pivotably disposed on a holder member that supports the driven roller, and having a restraining section at a position distant from a pivot axis of the pivot member; the restraining unit further include a cam unit that pivots the pivot member, and a drive source that drives the cam unit.

In this case, since the restriction state of the pivot member (the restraining member) is switched by the cam unit driven by the drive source, the degree of the restraint by the restraining section on the recording medium to prevent the recording medium from rising can be reduced or the restraint can be removed at appropriate timing.

According to a second aspect of the invention, a recording apparatus includes a recording unit that performs recording on a recording medium and the transporting device according to the first aspect of the invention. The recording apparatus has advantages similar to the advantages of the above-described transporting device.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
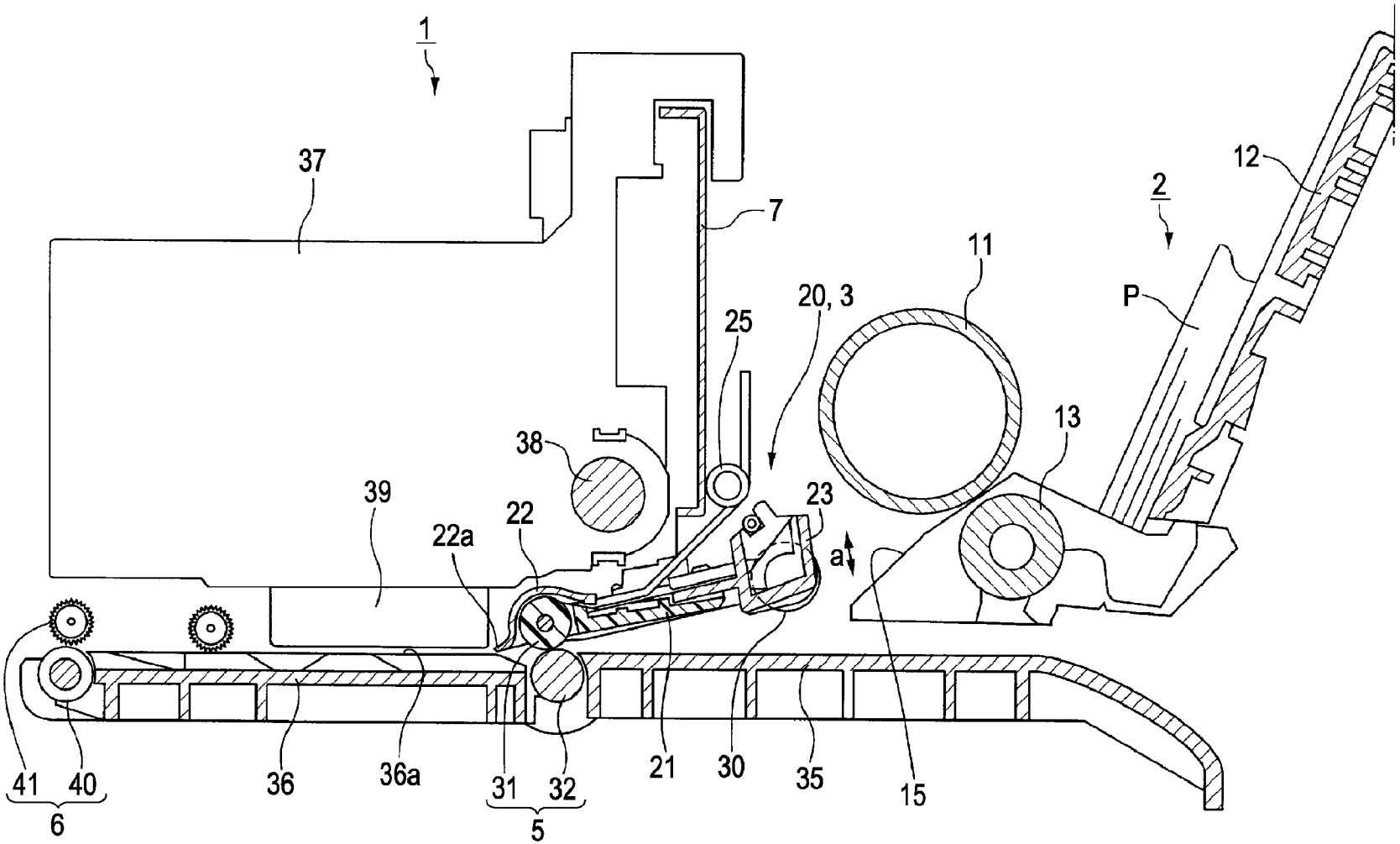
FIG. 1 shows a schematic cross-sectional view of a printer according to an embodiment of the invention.

Referring to FIG. 1, the overall structure of an ink jet printer 1 (hereinafter referred to as a printer 1) which is a recording apparatus according to an embodiment of the invention, is outlined below. The printer 1 has a feed unit 2 that feeds a recording sheet (hereinafter referred to as a sheet P) serving as a recording medium. The feed unit 2 includes a feed roller 11, a hopper 12, a retard roller 13, and other components not shown in the figure.

The hopper 12 is plate-like and pivotable about an axis (not shown) at an upper portion of the hopper. By pivoting, the hopper 12 can take two positions: a pressure contact position at which the sheet P, held at an angle on the hopper 12, is pressed against the feed roller 11; and a separated position at which the sheet P is separated from the feed roller 11.

The feed roller 11 is cylindrical and rotates to feed the uppermost sheet P, which is pressed to the roller, in the downstream direction. The retard roller 13, whose outer surface is made of an elastic material, is disposed to be in pressure contact with the feed roller 11. A predetermined rotational resistance is applied to the retard roller 13 by a torque limiter. The retard roller 13 serves to prevent double feeding of the sheet P by pinching the sheet P between the retard roller 13 and the feed roller 11.

The retard roller 13 is disposed such that it can be advanced to and retracted from the feed roller 11. In a normal sheet feed mode, the retard roller 13 is retracted from the feed roller 11 after the leading edge of the sheet P has reached a transporting unit 5 (described below). In a rapid sheet feed mode, the retard roller 13 is almost always at a position such that the retard roller 13 has been advanced to contact the feed roller 11, pinching the sheet P between the retard roller 13 and the feed roller 11.

A rear sheet guide 35 that guides the sheet P to a transporting device 3 is disposed downstream of the feed unit 2. The leading edge of the sheet P, which is fed by the feed unit 2, proceeds to the transporting device 3, while being guided by the rear sheet guide 35. Guide rollers 30 restrain a posture of the sheet P after the sheet has reached the transporting unit 5.

The transporting device 3 includes the transporting unit 5 and a restraining unit 20. The transporting unit 5 has a transport drive roller 32 rotated by a motor and transport driven rollers 31 rotated in pressure contact with the transport drive roller 32. The restraining unit 20 supports the transport driven rollers 31.

The transport drive roller 32 includes a metal shaft along the width of the sheet, and an adhesive layer formed on the outer surface of the metal shaft with uniformly dispersed wear-resistant particles. The transport driven rollers 31 are arranged along the axis of the transport drive roller 32. The outer surfaces of the transport driven rollers 31 are made of a low friction material such as polyacetal resin. The restraining unit 20 is described in detail later.

After reaching the transporting unit 5, the sheet P is transported downstream toward a recording head 39 by the rotation of the transport drive roller 32, while being nipped between the transport drive roller 32 and the transport driven rollers 31. The rotation axis of the transport driven rollers 31 is disposed slightly downstream of the rotation axis of the transport drive roller 32 so that the rollers 31 and 32 feed the sheet P toward the top faces of ribs 36*a* (described later). That is, the sheet P fed out of the transporting unit 5 is transported downstream while being pressed against the top faces of the ribs 36*a*. Accordingly, the sheet P is prevented from rising above the ribs 36*a* (front sheet guide 36), which serves to provide an excellent recording quality.

Ink is supplied from ink cartridges (not shown) each of which is dedicated to a single color. The recording head 39 serving as a recording unit is disposed on the bottom surface of a carriage 37. The carriage 37 is driven by a motor (not shown) to reciprocate in the main scanning direction, which is the direction perpendicular to the surface of FIG. 1, while being guided by a main frame 7 and a carriage guide shaft 38 extending in the main scanning direction.

Figure 2:
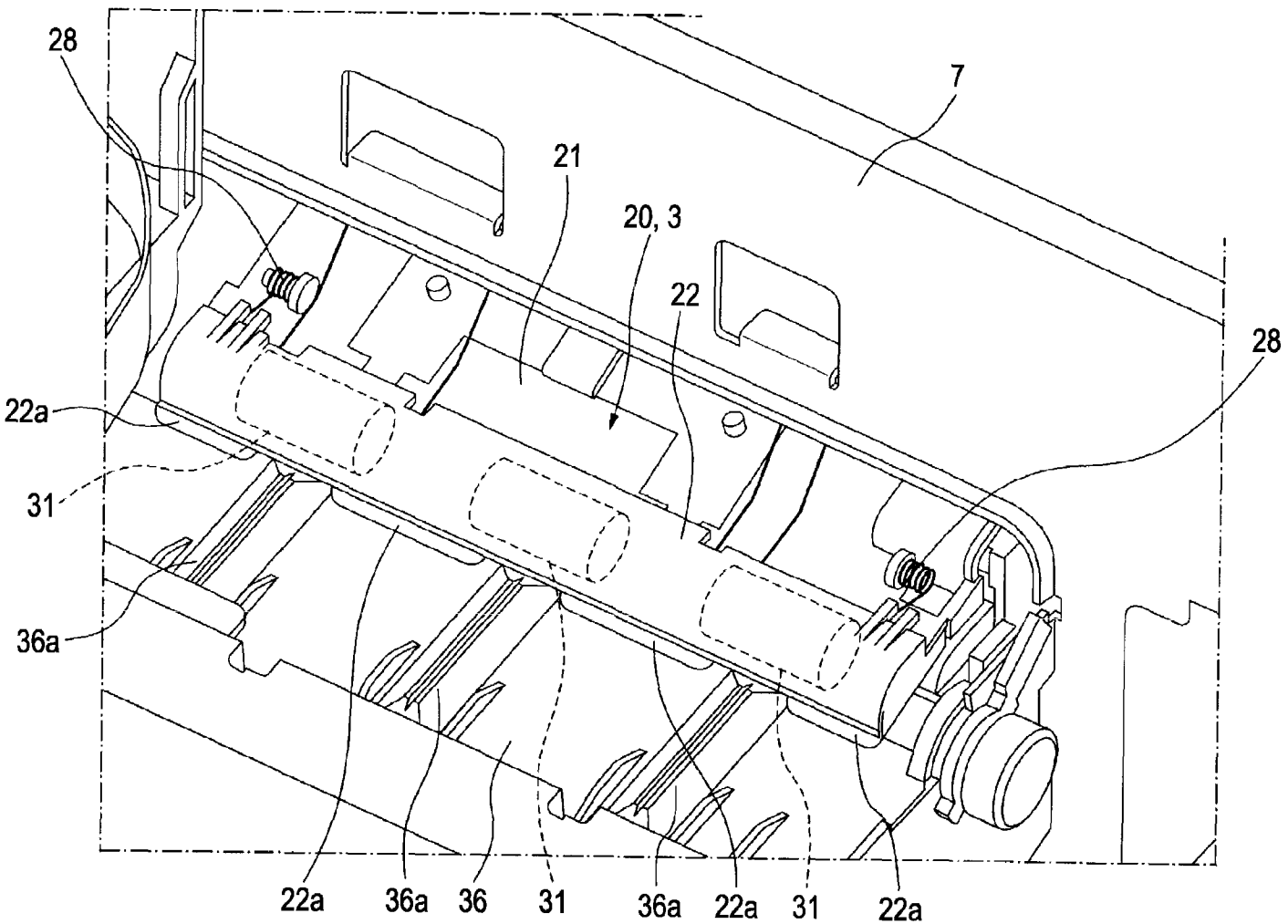
FIG. 2 shows a perspective view of a transporting device according to the embodiment of the invention.

The front sheet guide 36 is disposed opposite the recording head 39. As shown in FIG. 2, the front sheet guide 36 has the ribs 36*a* that extend in the sheet transporting direction. The ribs 36*a* are arranged at appropriate intervals thereamong in the direction perpendicular to the sheet transporting direction. The front sheet guide 36 supports and guides the sheet P downstream.

A discharging unit 6 is disposed downstream of the front sheet guide 36 and the recording head 39. The discharging unit 6 includes a discharge drive roller 40 that is rotated by a motor (not shown) and a discharge driven roller 41 that is rotated in contact with the discharge drive roller 40. The discharging unit 6 discharges the sheet P, on which recording has been performed, to a stacker (not shown) disposed on a front side of the printer 1.

The discharging unit 6 also serves as a transporting unit to transport the sheet P when the recording is performed on an area near the trailing edge of the sheet P without leaving a white space. To record on the area near the trailing edge of the sheet P, recording has to be performed on the sheet P after the trailing edge has passed the transporting unit 5. Therefore, after the trailing edge of the sheet P has passed the transporting unit 5, the discharging unit 6 feeds the sheet P precisely to allow the recording head 39 to perform recording on the sheet P.

The printer 1 has been outlined above. Referring to FIGS. 2 to 5, the restraining unit 20 is described in detail below. The restraining unit 20 includes an upper sheet guide 21; a first movable member 22; a second movable member 23; coil springs 25, 26 and 28; a tension spring 27; the guide rollers 30; the transport driven rollers 31; and other components that are not listed here.

The upper sheet guide 21, made from a resin, is a base component of the restraining unit 20. A plurality of (in this embodiment, three) transport driven rollers 31 are supported in a rotatable manner on the upper sheet guide 21 by a rotation shaft 31*a* of the transport driven rollers 31. The upper sheet guide 21 has pivot points (bosses) 21*a* that are supported in a rotatable manner by bearings (not shown) on the main frame 7. Therefore, the upper sheet guide 21 is pivotable about the pivot points 21*a*, when viewed across the sheet transporting path. The coil springs 25 and 26, exerting spring biases between the main frame 7 and the upper sheet guide 21, urge the upper sheet guide 21 in the pivoting direction to press the transport driven rollers 31 against the transport drive roller 32.

The first movable member 22 serving as a restraining member is shaped to cover the transport driven rollers 31. The first movable member 22 is supported by the upper sheet guide 21 to be pivotable, when viewed across the sheet transporting path. The pivot axis of the first movable member 22 coincides with the rotation axis of the transport driven rollers 31.

Restraining sections 22*a*, shaped like tongues, are formed at one end of the first movable member 22 (the end of a first movable member 22 at a position distant from the pivot axis). As shown in FIG. 2, each one of the restraining sections 22*a* is disposed between a pair of adjacent ribs 36*a* on the front sheet guide 36. The coil springs 28, exerting spring biases between the first movable member 22 and the upper sheet guide 21, urge the first movable member 22 in the pivoting direction (clockwise in FIG. 4) such that the restraining sections 22*a* are separated from the front sheet guide 36.

On the upper sheet guide 21, the second movable member 23 is disposed to be slidable in the direction of arrow "a" in FIG. 1. The second movable member 23 has a plate section 24 with tongues 24*a* formed on one end. The tongues 24*a* are engageable with engaging sections 22*b* of the first movable member 22.

Figure 3:
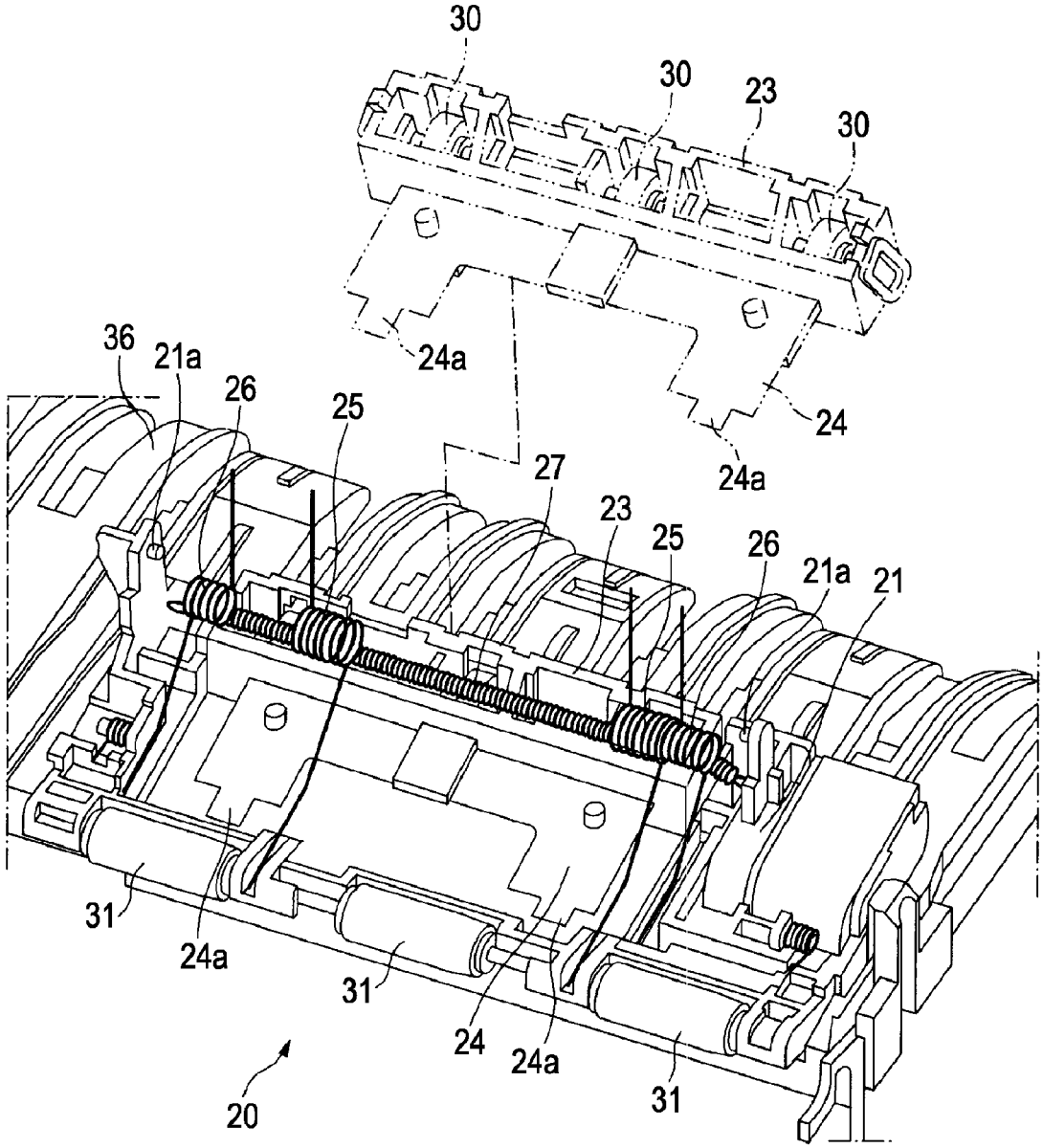
FIG. 3 shows a perspective view of a restraining unit according to the embodiment of the invention.
Figure 4:
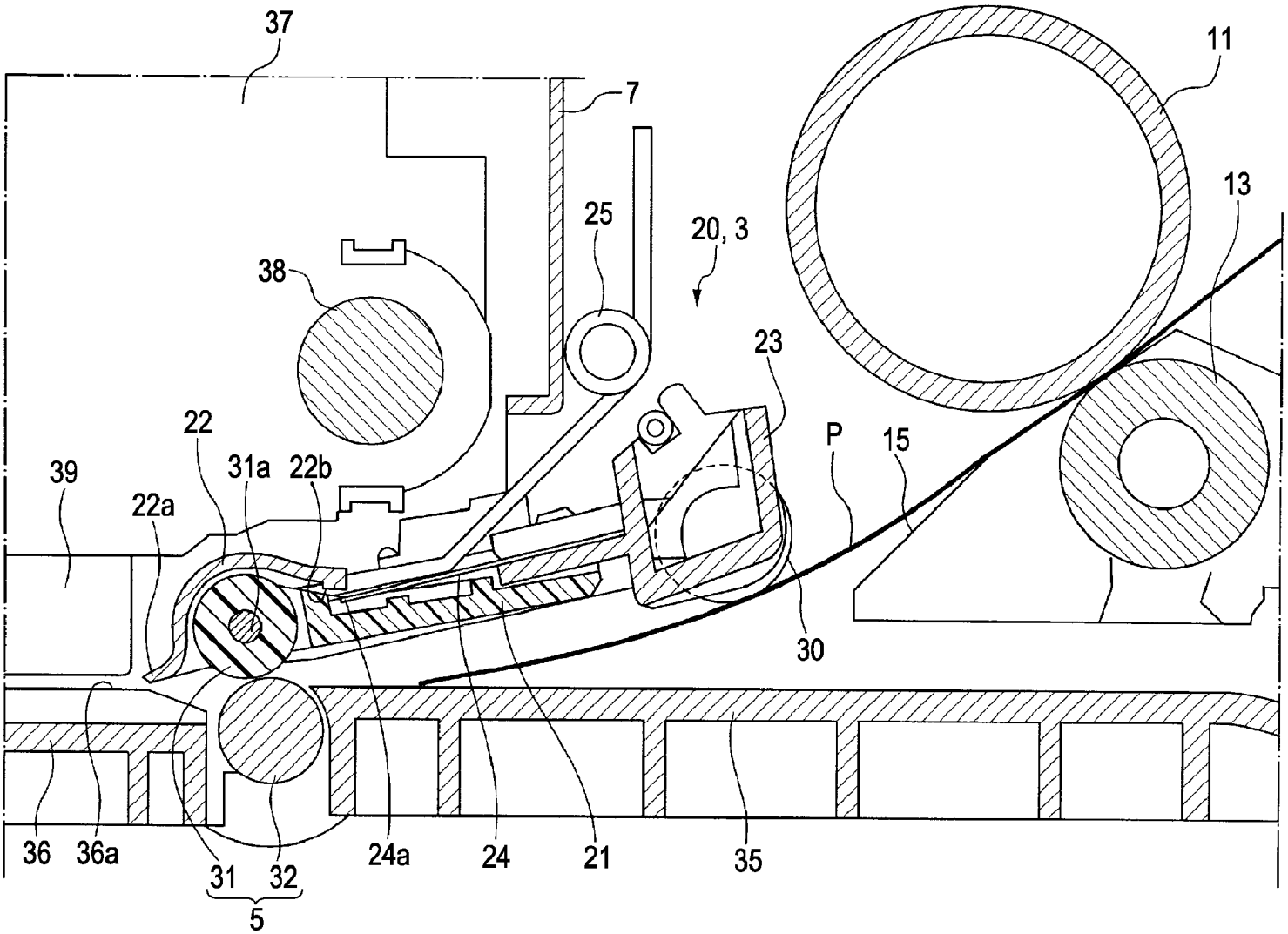
FIG. 4 shows a cross-sectional view of a transporting device according to the embodiment of the invention.

Normally, the second movable member 23 is urged downward with the tension spring 27 as shown in FIG. 3, and the tongues 24*a* are positioned below the engagement sections 22*b* of the first movable member 22, as shown in FIG. 4. In this state, the second movable member 23 is (the tongues 24*a* are) disengaged from the first movable member 22 to be at a position at which the second movable member 23 does not restrict movement of the first movable member 22 (an unrestricted state of the first movable member 22). Hereinafter, the position of second movable member 23 in this state is called an unrestrictive position.

The second movable member 23 supports the guide roller 30 serving as a contact section in a rotatable manner. Because the guide roller 30 protrudes into the transportation path of the recording sheet, the guide roller 30 and the second movable member 23 are pushed upward according to the state of the sheet P being fed by the feed unit 2 (FIG. 5).

Figure 5:
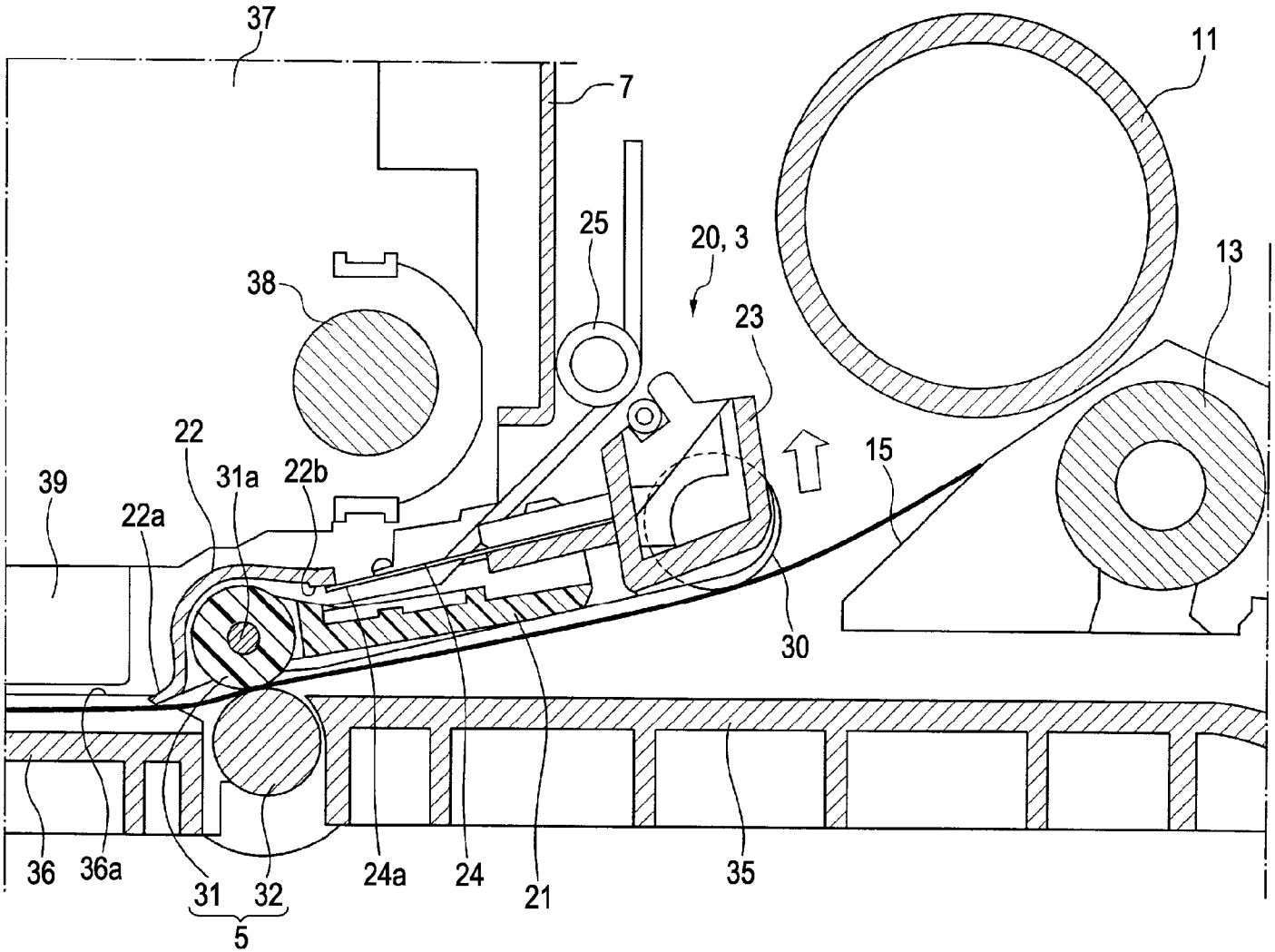
FIG. 5 shows a cross-sectional view of a transporting device according to the embodiment of the invention.

As shown in FIG. 5, when the second movable member 23 is pushed upward, the tongues 24*a* of the second movable member 23 push the engaging sections 22*b* of the first movable member 22 upward. Then, the first movable member 22 pivots in a direction such that the restraining sections 22*a* approach the front sheet guide 36 and the first movable member 22 is restricted to this state (a restricted state of the first movable member 22). Hereinafter, the position of the second movable member 23 in this state is called a restrictive position.

As described above, the first movable member 22 (the restraining member) is switchable between the restricted state in which the first movable member is restricted by the second movable member 23 and the unrestricted state in which the first movable member is not restricted by the second movable member 23. The second movable member 23 is movable between the restrictive position at which the second movable member 23 restricts the first movable member 22 and the unrestrictive position at which the second movable member 23 does not restrict the first movable member 22.

Operations and functions of the transporting device 3 (the restraining unit 20), configured as above, are described in detail below. In a period before or a little after the leading edge of the sheet P, fed by the feed unit 2, reaches the transporting unit 5, a tension applied to the sheet P between the transporting unit 5 and the feed roller 11 is low. Since the sheet P droops, the second movable member 23 is at the unrestrictive position at which the second movable member 23 is not pushed up by the sheet P (FIG. 4). Therefore, the restraining sections 22*a* of the first movable member 22 are slightly above the top faces of the ribs 36*a*, as shown in FIG. 4.

As the tension applied to the sheet P between the transporting unit 5 and the feed roller 11 increases, the sheet P moves upward and pushes up the second movable member 23 and changes the position of the second movable member 23 from the unrestrictive position to the restrictive position. Then, a first movable member 22 pivots in the direction such that the restraining sections 22*a* approach the front sheet guide 36 (FIG. 5).

In this state, the restraining sections 22*a* are slightly below the top faces of the ribs 36*a*. Therefore, when the transporting unit 5 transports the sheet P in this state, the restraining sections 22*a* reliably restrain (more strictly restrain) the sheet P from rising above the front sheet guide 36.

In this state, the restraining sections 22*a* apply a transport load to the sheet P. If the trailing edge of the sheet P passes the restraining sections 22*a* in this state, the transport load fluctuates sharply, decreasing the accuracy with which the sheet P is fed. In particular, the trailing edge of the sheet P is free from the restraint applied by the transporting unit 5 after the trailing edge has passed the transporting unit 5. Thus, the feeding accuracy is easily decreased when the trailing edge of the sheet P passes the restraining sections 22*a*.

In comparison, with the restraining unit 20 according to this embodiment, at least after the trailing edge of the sheet P has passed the guide roller 30, the second movable member 23 becomes free from the pressure from the sheet P and moves downward from the restrictive position to the unrestrictive position. Therefore, the first movable member 22, released from the restriction by the second movable member 23, pivots in a clockwise direction from the state in FIG. 5 such that the restraining sections 22*a* move away from the front sheet guide 36. That is, the degree of the restraint applied to the sheet P by the restraining sections 22*a* is reduced.

Thus, the degree of the restraint applied by the restraining sections 22*a* for preventing the sheet P from rising is reduced when the trailing edge of the sheet P passes the restraining sections 22*a*. Therefore, a reduction in feeding accuracy, which is caused when the trailing edge of the sheet P passes the restraining section 22*a* while the restraining section 22*a* is in a strongly restrained state, is prevented.

In this embodiment, a guide surface 15 for guiding the sheet P downstream is disposed between the feed roller 11 and the transporting unit 5. The guide surface 15 serves to curve the sheet P irrespective of whether or not the sheet P is pinched between the retard roller 13 and the feed roller 11 after the trailing edge of the sheet P has passed the nip between the two rollers.

Therefore, until the trailing edge of the sheet P passes the guide surface 15, particularly when the trailing edge of the sheet P is on an upstream portion of the guide surface 15, a second movable member 23 is pushed up by the sheet P. While the trailing edge of the sheet P proceeds along the guide surface 15, the sheet P gradually descends and gradually changes the position of the second movable member 23 from the restrictive position to the unrestrictive position.

In the restraining unit 20, the sheet P applies a pressure to the second movable member 23, thereby switching the first movable member 22 to the restricted state from the unrestricted state. Thus, the strength with which the restraining sections 22*a* restrain the sheet P from rising can be adjusted at low cost without using a driving source such as a motor.

In the above-described embodiment, the degree of the restraint applied to the restraining sections 22*a* to prevent the sheet P from rising is reduced when the trailing edge of the sheet P passes the guide surface 15 upstream of the guide roller 30. However, a reduction in feeding accuracy that occurs when the trailing edge of the sheet P passes the restraining sections 22*a* can be prevented by the structure such that the degree of the restraint applied by the restraining sections 22*a* is reduced at least before the trailing edge of the sheet P passes the transporting unit 5.

Figure 6A:
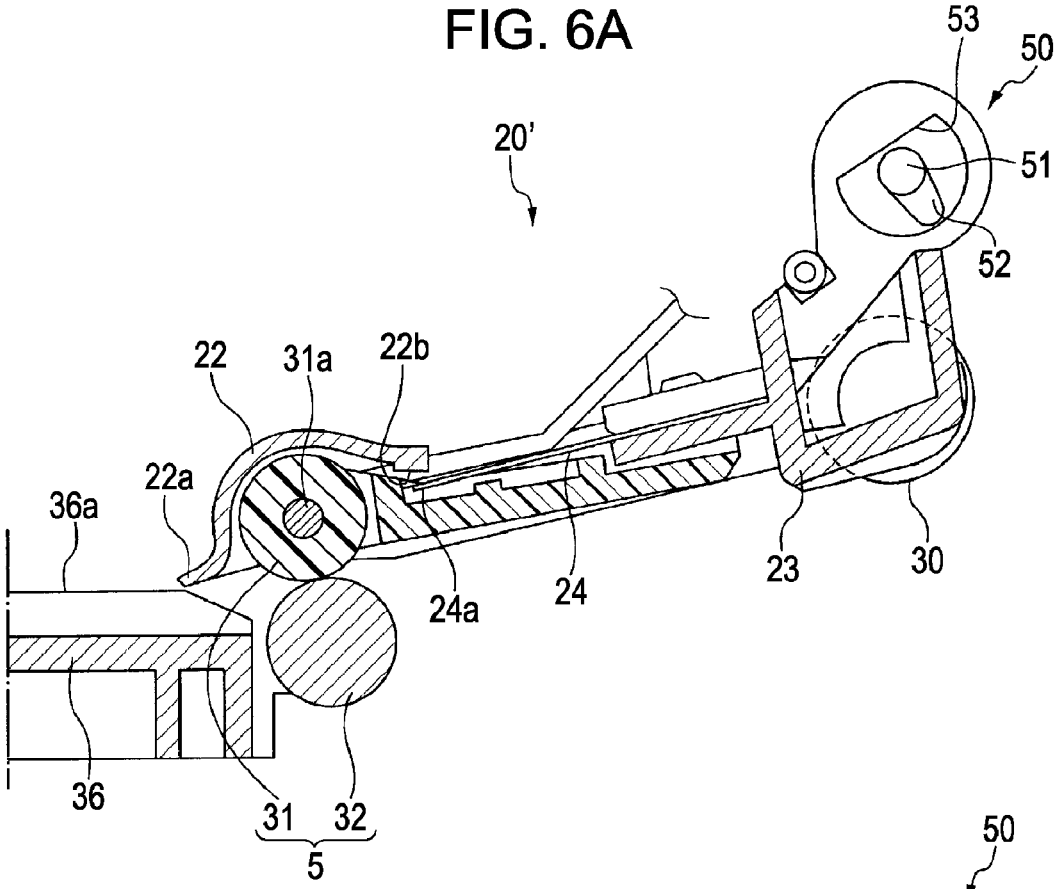
FIGS. 6A and 6B show cross-sectional views of a transporting device according to another embodiment of the invention.
Figure 6B:
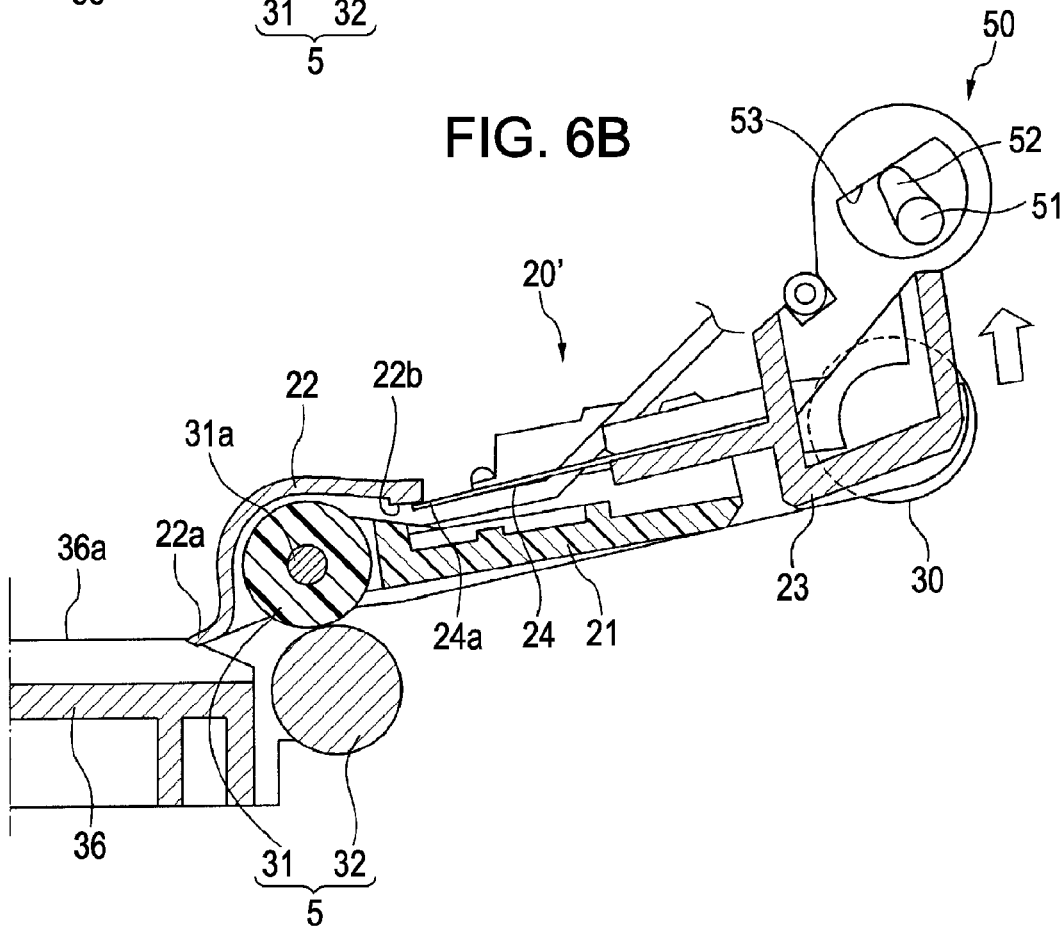

To precisely adjust the timing at which the degree of the restraint applied by the restraining sections 22*a* is reduced, it is preferable to use a dedicated drive source as shown in FIGS. 6A and 6B. FIGS. 6A and 6B are cross-sectional views of a restraining unit 20' according to another embodiment. The restraining unit 20 and the restraining unit 20' differ in that the restraining unit 20' includes a cam unit 50 having a cam follower 53 integrated with the second movable member 23, a cam 52 engaged with the cam follower 53, and a rotation shaft 51 for the cam 52. For the elements that have been described, like numbers reference like elements in FIGS. 6A and 6B.

FIG. 6A shows a state when a second movable member 23 serving as a pivot member is in an unrestrictive position at which the second movable member 23 does not restrict a first movable member 22, which corresponds to the state shown in FIG. 4. In this state, the cam follower 53 is disengaged from the cam 51 and not pushed up by the cam 51.

The rotation shaft 51 is driven by a motor (not shown). When the rotation shaft 51 rotates from the position shown in FIG. 6A, the cam 51 pushes up the cam follower 53 and the second movable member 23 to a restrictive position at which the second movable member 23 restricts the first movable member 22, as shown in FIG. 6B. Since the degree of the restraint applied by the restraining sections 22*a* to restrain the sheet P from rising is controlled by using the dedicated drive source (such as a motor), the timing at which the degree of the restraint is changed can be adjusted appropriately.

What is claimed is:

1. A recording medium transporting device, comprising:

a transporting unit that transports a recording medium, the transporting unit applying tension to the recording medium as the recording medium is transported;

a guide member that supports and guides the recording medium in a downstream direction, the guide member being disposed downstream of the transporting unit; and a restraining unit that includes a restraining member having a restraining section, the restraining section being movable relative to the guide member, wherein the restraining section uses the tension of the recording medium to impose a restraint on the recording medium to prevent the recording medium from rising above the guide member at a position downstream of the transporting unit, and wherein a restriction state of the restraining member is switchable using the tension of the recording medium between at least two states, and the restriction state is switched so that a degree of the restraint is reduced or the restraint is removed before a trailing edge of the recording medium passes the restraining section.

2. The recording medium transporting device according to claim 1, wherein the restraining unit reduces the degree of the restraint or removes the restraint imposed by the restraining section before the trailing edge of the recording medium passes the transporting unit.

3. The recording medium transporting device according to claim 1, wherein the transporting unit includes a drive roller that is rotated and a driven roller that is rotated by contacting the drive roller, wherein the restraining unit includes a first movable member serving as the restraining member, the first movable member being pivotably disposed on a holder member that supports the driven roller and having the restraining section at a position distant from a pivot axis of the first movable member, and a second movable member disposed on the holder member, the second movable member being engageable with the first movable member and capable of taking a restrictive position at which the second movable member restricts the first movable member to a state in which the first movable member is pivoted in a direction such that the restricting section approaches the guide member and an unrestrictive position at which the second movable member does not restrict the first movable member, wherein the second movable member includes a contact section that is capable of being in contact with the recording medium at a position upstream of the transporting unit, and wherein the second movable member moves from the unrestrictive position to the restrictive position as the recording medium applies a pressure to the contact section when the trailing edge of the recording medium is upstream of the contact section, and the second movable member takes the unrestrictive position as the pressure on the contact section applied by the recording medium is released after the trailing edge of the recording medium passes the contact section.

4. The recording medium transporting device according to claim 3, wherein the contact section includes a roller that is rotatable in contact with the recording medium.

5. The recording medium transporting device according to claim 1, wherein the transporting unit includes a drive roller that is rotated and a driven roller that is rotated by contacting the drive roller, wherein the restraining unit includes a pivot member serving as the restraining member, the pivot member being pivotably disposed on a holder member that supports the driven roller, and having a restraining section at a position distant from a pivot axis of the pivot member, a cam unit that pivots the pivot member, and a drive source that drives the cam unit.

6. A recording apparatus, comprising:

a recording unit that performs recording on a recording medium; and the transporting device according to claim 1.

* * * * *